United States Patent [19]

Forkum, Jr.

[11] 4,268,774

[45] May 19, 1981

[54] SPARK PLUG WITH GROUND ELECTRODE HAVING DIVERGING PRONGS

[76] Inventor: Maston Forkum, Jr., Rte. 10, Box 43, Blair La., Lebanon, Tenn. 37087

[21] Appl. No.: 29,542

[22] Filed: Apr. 12, 1979

Related U.S. Application Data

[63] Continuation-in-part of Ser. No. 763,337, Jan. 28, 1977, abandoned, which is a continuation-in-part of Ser. No. 658,713, Feb. 17, 1976, abandoned, which is a continuation-in-part of Ser. No. 473,400, May 28, 1974, abandoned.

[51] Int. Cl.[3] ..... H01T 13/32

[52] U.S. Cl. ..... 313/141

[58] Field of Search ..... 313/141, 142, 140

[56] References Cited

U.S. PATENT DOCUMENTS 1,538,870 5/1925 Champion ..... 313/140

2,894,162 7/1959 Ignatjev ..... 313/141

FOREIGN PATENT DOCUMENTS 2346663 4/1974 Fed. Rep. of Germany ..... 313/141

*Primary Examiner*—Palmer C. Demeo

*Attorney, Agent, or Firm*—LeBlanc, Nolan, Shur & Nies

[57] ABSTRACT

An IC engine spark plug wherein the gap-defining end of the ground electrode is split or divided to form two continuously diverging non-parallel angularly spaced apart end portions, the base or vertex region where the end portions join together being so located relative to the plug's center electrode that a spark bridging the plug's spark gap impinges first at the base region and then splits for simultaneous travel along the end portions.

9 Claims, 5 Drawing Figures

FIG. 1
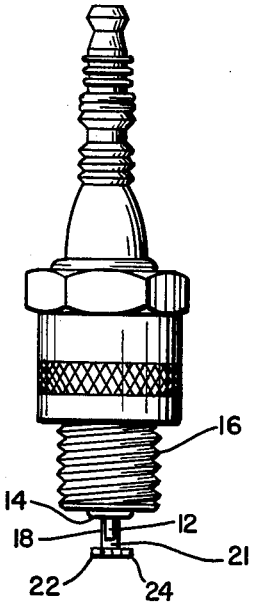
FIG. 2
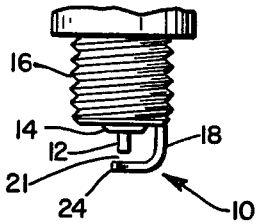
FIG. 3
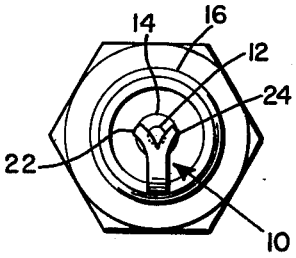
FIG. 4
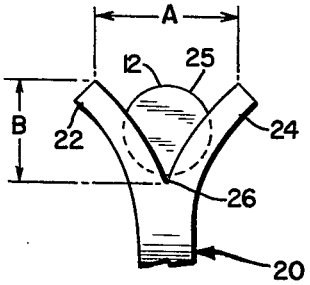
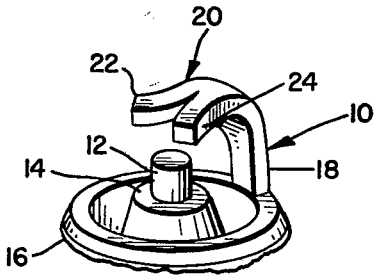
FIG. 5

SPARK PLUG WITH GROUND ELECTRODE HAVING DIVERGING PRONGS

RELATED APPLICATIONS

This application is a continuation-in-part of my earlier application Ser. No. 763,337 filed Jan. 28, 1977, and now abandoned, said application Ser. No. 763,337 being in turn a continuation-in-part of my now abandoned application Ser. No. 658,713 filed Feb. 17, 1976, said application Ser. No. 658,713 being in turn a continuation-in-part of my now abandoned application Ser. No. 473,400 filed May 28, 1974.

FIELD OF THE INVENTION

The present invention generally relates to spark plugs for igniting the fuel charge in an internal combustion engine and is particularly concerned with an improved spark plug construction which improves gasoline mileage, diminishes exhaust pollution and reduces plug-fouling carbon buildup as compared with known prior plugs.

BACKGROUND

In conventional IC engine spark plugs of the type currently in widespread use, the ground electrode terminates in a single arm or gap-defining end portion which extends radially of the plug's center electrode at a region where it is spaced axially from the end of the center electrode and is intersected by the center electrode's longitudinal axis. Although such spark plugs work satisfactorily, they nevertheless leave considerable room for improvement.

Various spark plug constructions have therefore been proposed in an effort to improve engine and plug performance. For example, the Jay Norris Corporation, on page 5 of the January, 1974 issue of Tennessee Magazine advertised a wideswath, jet-fire fuel ignitor or spark plug in reference to U.S. Pat. No. 2,889,585, claiming that the plug would "walk a strong sure swath of flame from one electrode to another across a semiconductor bridge to fire each cylinder with absolute reliability."

In another plug construction described in U.S. Pat. No. 2,894,162 which issued to F. Ignatjev, more efficient combustion is asserted by utilizing a special ground electrode construction. According to this patent, the ground electrode is formed with two parallel spaced apart end portions arranged on opposite sides of the center electrode's axis. At their regions remote from their free ends, the parallel end portions extend considerably beyond the peripheral limits of the center electrode and join with a V-shaped portion lying remote from the peripheral limit of the center electrode.

By the foregoing construction, Ignatjev states that the spark will jump between the center electrode and one of the ground electrode's two end portions or tips and furthermore will alternate between the two tips on successive firings.

SUMMARY AND OBJECTS OF INVENTION

With the foregoing in mind, the general aim and purpose of my invention is to provide a novel spark plug which, as compared with the conventional type of plug described above and the plug described in U.S. Pat. No. 2,894,162, provides improved gas mileage, less pollution in the engine exhaust and reduced carbon buildup on the plug. The net result is a significant savings in energy, longer lasting plug life and improved engine performance.

The foregoing object is accomplished by a unique ground electrode construction which is divided at its gap-defining end to form two angularly spaced apart non-parallel prongs or arm portions terminating in free ends and joined together at a base or vertex region to define a generally V-shaped configuration. Unlike Ignatjev's proposal for alternating the spark between the two ground electrode tips, the V-shaped prong configuration in my invention is so arranged and oriented relative to the center electrode that a spark jumping the gap between the center electrode and the ground electrode will first impinge at the base or vertex region where the two prongs join together and then will split to concomitantly travel along the two prongs. It is believed that the splitting of the spark and the simultaneous travel along the two angularly spaced apart non-parallel prongs is the commanding factor contributing to better mileage, less pollution in the engine exhaust and reduced carbon buildup on the electrodes.

To achieve this highly advantageous splitting action of the spark, the location of the ground electrode's vertex or base region relative to the center electrode is of critical importance. If it is too far behind the peripheral limits of the center electrode, as is the case in the Ignatjev patent, the spark will not be initially attracted to the vertex or base region at the juncture between the two prongs and will not split from simultaneous travel along the prongs. Instead, it will at best jump directly between the center electrode and just one of the prongs with the result that the plug will operate just like a conventional plug. On the other hand, if the vertex or base region is located too close to the center electrode's longitudinal axis. The spark may not split and, more importantly, the improved results mentioned above will not be achieved and excessive carbon may build up on the ground electrode.

For achieving the desired splitting action of the spark I found in practice that the aforementioned vertex or base region should be located at least approximately at the peripheral limit of the center electrode behind the center electrode's longitudinal axis or any where up to and including approximately 2 mm behind the peripheral limit of the center electrode. The optimum location of the vertex region within this range or zone may vary depending upon various factors such as the particular construction of the spark plug itself.

Preferably, the gap-defining end of the ground electrode is sufficiently long before splitting that it extends at its free end somewhat beyond the peripheral limit of the center electrode. For optimum results the spacing between the free ends of the ground electrode's end portions is in the range extending approximately from 2 mm for a center electrode of relatively small diameter or size to about 4 mm for a center electrode of relatively large size. Furthermore, the spacing is such that segments of the two diverging, non-parallel end portions preferably lie within the peripheral limits of the center electrode.

DESCRIPTION OF DRAWINGS

FIG. 1 is a front elevation of a spark plug incorporating the principles of my invention;

FIG. 2 is a fragmentary side elevation of the plug shown in FIG. 1;

FIG. 3 is a plan view of the plug shown in FIG. 1 as seen from the spark-producing electrode end of the plug;

FIG. 4 is an enlarged fragmentary perspective view of the plug shown in FIG. 1; and FIG. 5 is a plan view similar to FIG. 3, but enlarged to illustrate the center and ground electrode arrangement more clearly.

DETAILED DESCRIPTION

Except for the ground electrode (indicated at 10 in the drawings) the IC engine spark plug incorporating the principles of this invention is conventional and mainly comprises a straight, longitudinally extending center electrode 12 peripherally surrounded by a procelin insulating core 14 which is mounted in a metal shell or housing 16. At the gap-defining ends of the electrodes 10 and 12, shell 16 has a rim or skirt which is externally threaded for mounting in an engine block in the usual manner.

As shown, center electrode 12 may be cylindrical and projects at its gap defining end beyond the insulating core or sleeve 14. The ground electrode 10 is suitably joined to and depends from the threaded skirt of housing 16. Ground electrode 10 is bent in the usual manner to form a depending portion 18 extending parallel to center electrode 12 and an end section 20 extending inwardly toward center electrode 12. End section 20 lies at least generally in a plane normally intersecting the longitudinal axis of center electrode 12 and additionally lies radially with respect to the longitudinal axis of center electrode 12. End section 20 is axially spaced from the near end of center electrode 12 to define therewith the spark plug gap which is indicated at 21.

As best shown in FIGS. 2–4 the ground electrode's end section 20 is medially divided along a line extending radially of the center electrode's longitudinal axis to form two continuously diverging non-parallel angularly spaced apart end portions or prongs 22 and 24. End portions 22 and 24 may be straight, but preferably are slightly curved outwardly away from each other as shown. The ends of portions 22 and 24 need not be rounded, and these portions need not be tapered.

As shown, the end portions 22 and 24 remote from their free ends are integrally joined together at a vertex or base region 26 which lies on a line extending radially of the center electrode's longitudinal axis. End portions 22 and 24 diverge continuously away from each other throughout their entire length in the direction extending from the vertex region 26 to the free ends of the end portions. End portions 22 and 24 are therefore non-parallel throughout their entire length.

Preferably, the free ends of end portions 22 and 24 extend somewhat beyond the peripheral limit of center electrode 12. Additionally, end portions 22 and 24 are preferably symmetrically disposed on opposite sides of a plane containing the center electrode's longitudinal axis and passing through the vertex or base region 26. The angular spacing between end portions 22 and 24 is such that the center electrode's longitudinal axis extends medially between end portions 22 and 24 as shown. As such, end portions 22 and 24 define a generally V-shaped configuration as shown.

As previously mentioned the location of the vertex or base region 26 at the juncture of end portions 22 and 24 relative to center electrode 12 is of critical importance if the desired splitting action of the spark and the simultaneous travel of the split spark portions along end portions 22 and 24 is to be obtained. I have established that such location for the vertex or base region 26 may be located at or at least approximately at the peripheral limit of center electrode 12 or anywhere up to and including approximately 2 mm beyond the center electrode's peripheral limit to lie between the center electrode's peripheral limit and the ground electrode's depending portion 18. It is understood that the peripheral limit of center electrode 12 may be defined by an envelope (indicated at 25) containing the center electrode's periphery and extending in the region of end section 20.

The optimum location of the vertex or base region or point 26 within the foregoing range is determined by various factors such as the particular construction of the spark plug itself. For example, the vertex region 26 may be spaced approximately 1 mm beyond the peripheral limit of center electrode 12 in spark plug constructions having a relatively small center electrode size or diameter. In the illustrated embodiment the vertex region 26 is shown to lie just slightly behind the peripheral limit of center electrode 12. By virtue of the foregoing construction a spark jumping the spark plug gap 21 will first impinge at the vertex region 26 and then will split to travel simultaneously along the ground electrode's end portions 22 and 24 to assure a more complete combustion of the fuel charge as compared with conventional plug constructions. Upon splitting one of the split segments of the spark will extend between electrode 12 and prong 22, and the other will extend between electrode 12 and prong 24.

As previously noted, if the vertex or base region 26 is located too far behind the peripheral limit of center electrode 12 between the center electrode's peripheral limit and the ground electrode's depending portion 18, the spark bridging the gap 13 will not initially impinge at the vertex region, but instead will jump directly to one or the other of the end portions 22 and 24, thus resulting in a spark plug operation like that of conventional plugs with no improvement in gas mileage or reduction in the pollutants in the engine exhaust. On the other hand, if the split dividing end portions 22 and 24 is too short to locate vertex region 26 too close to the center electrode's longitudinal axis no significant improvement in gasoline mileage will be realized and excessive carbon deposits may build up on the ground electrode.

The spacing between the free ends of end portions 22 and 24 is indicated by the dimension A in FIG. 4. This dimension is measured in a plane that is parallel to a line extending tangentially of the center electrode's periphery. This spacing represented by dimension A is such that a segment of each of the end portions 22 and 24 will lie within the center electrode's peripheral limit 25. For optimum results the spacing A between the free ends of end portions 22 and 24 should be in the range extending approximately from 2 mm to and including approximately 4 mm. Spacing A normally increases as the length of the split (indicated by dimension B) between end portions 22 and 24 is increased. If the vertex or base region 26 is located about 1 to 2 mm behind the peripheral limit 25 of center electrode 12 for a relatively large center electrode then the dimension A will be approximately 4 mm. For relatively small sizes of center electrodes, on the other hand, dimension A may be about 2 mm.

Preferably the free ends of end portions 22 and 24 extend somewhat beyond the peripheral limit of center electrode 12 as best shown in FIG. 4. In this regard it is preferred that before being split to form end portions 22 and 24, end section 20 extends at its free end roughly about 1 mm the peripheral limit of center electrode 12.

Examples of dimensions A and B are as follows: for a modified ARF52 Autolite spark plug used in Lincoln and Ford automobiles, dimension B is about 5 mm and dimension A is about 4 mm. For a modified R44T AC spark plug used in Chevrolet automobiles, dimension B is about 4 mm and dimension A is about 3 mm. For a modified CS45 AC spark plug of the type used for chain saws and lawn mowers, dimension B is about 4 mm and dimension A is about 3 mm. For an L77J Champion spark plug used in outboard motors dimension B is about 3.3 mm and dimension A is about 2 mm. The spark plug gap will vary depending upon the spark plug construction and other factors and usually is in the range extending from approximately 0.015 inches to at least 0.065 inches.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A spark plug for igniting the fuel charge in an internal combustion engine and having a metal housing, an insulator carried by said housing, an elongated center electrode peripherally surrounded by said insulator and having a free gap-delimiting end projecting axially beyond said insulator at one end of said housing, and a ground electrode extending from said housing at said one end thereof, said ground electrode having a gap-delimiting end portion extending radially with respect to the longitudinal axis of said center electrode at a region that is axially spaced from the free end of said center electrode to define a spark gap therewith, said end portion being split to form two angularly spaced apart non-parallel prongs terminating in free ends and being joined together remote from their free ends at a vertex region, said prongs diverging continuously away from each other throughout their entire lengths in a direction extending from said vertex region to their free ends to be non-parallel throughout their lengths, the angular spacing of said prongs being such that the longitudinal axis of said center electrode extends between said prongs, said vertex region lying between said longitudinal axis and the end of said end portion remote from the free ends of said prongs, and said vertex region further lying at or sufficiently close to the peripheral limit of said center electrode at such a location relative to said center electrode that an electrical spark bridging said gap impinges initially at said vertex region and then splits to travel simultaneously along both of said prongs.

2. The spark plug defined in claim 1 wherein said prongs are symmetrically disposed on opposite sides of a plane containing said longitudinal axis and passing through said vertex region.

3. The spark plug defined in claim 1 wherein the spacing between the free ends of said prongs are in the range extending approximately from 2 mm to approximately 4 mm.

4. The spark plug defined in claim 3 wherein an intermediate segment of each of said prongs is within the peripheral limit of said center electrode.

5. The spark plug defined in claim 1 wherein the free ends of said prongs extend beyond the peripheral limits of said center electrode.

6. The spark plug defined in any one of the claims 1, 2, 3 or 4 wherein said vertex region lies in a range of distances extending from about 0 mm to about 2 mm beyond the peripheral limit of said center electrode.

7. The spark plug defined in claim 1 wherein said prongs are disposed on opposite sides of a first plane containing said longitudinal axis and passing through said vertex region, and wherein each of prongs extends beyond a second plane normally intersecting said first plane and containing said longitudinal axis such that the free ends of said prongs are disposed on one side of said second plane while said vertex region is disposed on the other side of said second plane.

8. The spark plug defined in claim 7 wherein an intermediate segment of each of said prongs is within the peripheral limit of said center electrode.

9. The spark plug defined in any one of the claims 7 and 8 wherein said vertex region lies in a range of distances extending from about 0 mm to about 2 mm beyond the peripheral limit of said center electrode.

* * * * *